US008540230B2

(12) United States Patent
Yasuda

(10) Patent No.: US 8,540,230 B2
(45) Date of Patent: Sep. 24, 2013

(54) SHEET FEEDING APPARATUS AND IMAGE FORMING APPARATUS WITH CURVATURE FORMATION PORTION AND REVERSELY ROTATABLE FEEDING ROLLER

(75) Inventor: Junji Yasuda, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/541,486

(22) Filed: Jul. 3, 2012

(65) Prior Publication Data

US 2013/0161896 A1 Jun. 27, 2013

(30) Foreign Application Priority Data

Dec. 26, 2011 (JP) ..... 2011-283366

(51) Int. Cl.
*B65H 3/30* (2006.01)
*B65H 3/56* (2006.01)

(52) U.S. Cl.
CPC ..... *B65H 3/56* (2013.01)
USPC ..... 271/22; 271/24; 271/148; 271/118

(58) Field of Classification Search
USPC ..... 271/114, 115, 161, 167, 117, 118
See application file for complete search history.

(56) References Cited

U.S. PATENT DOCUMENTS

| | | | | | |
|---|---|---|---|---|---|
| 4,557,472 | A | * | 12/1985 | Hannon | 271/165 |
| 4,911,421 | A | * | 3/1990 | Hannon | 271/161 |
| 4,919,413 | A | * | 4/1990 | Hannon | 271/167 |
| 6,908,081 | B2 | * | 6/2005 | Takito et al. | 271/167 |

FOREIGN PATENT DOCUMENTS

| | | | | |
|---|---|---|---|---|
| JP | 5-147752 | A | | 6/1993 |
| JP | 05147752 | A | * | 6/1993 |
| JP | 2000-143002 | A | | 5/2000 |
| JP | 2000143002 | A | * | 5/2000 |

* cited by examiner

*Primary Examiner* — Gerald McClain
(74) *Attorney, Agent, or Firm* — Canon USA Inc IP Division

(57) ABSTRACT

When a sheet is fed, a feeding roller is rotated in the direction opposite to the direction in which the sheet is fed to draw out the uppermost sheet from a separation claw, and then the sheet is fed in such a manner that the feeding roller is rotated in the direction in which the sheet is fed to feed the drawn out sheet along the upper surface of a separation claw. When the sheet is fed, a curvature formation portion curves downward both ends in the width direction of the second and subsequent sheets to integrally lower pressing portions for pressing both ends in the width direction of the sheet along with the curved sheets and to separate the pressing portions from the uppermost sheet, thereby preventing the leading end of the uppermost sheet from catching the pressing portions.

16 Claims, 20 Drawing Sheets

SHEET FEEDING APPARATUS AND IMAGE FORMING APPARATUS WITH CURVATURE FORMATION PORTION AND REVERSELY ROTATABLE FEEDING ROLLER

BACKGROUND OF THE INVENTION

1. Field of the Invention

The present invention relates to a sheet feeding apparatus and an image forming apparatus and, in particular, to a configuration for separating sheets one by one.

2. Description of the Related Art

Conventionally, an image forming apparatus such as a facsimile machine, a copying machine, and a laser-beam printer includes a sheet feeding apparatus for feeding sheets such as plain paper, coated paper, plastic sheet and cloth to an image forming unit in the image forming apparatus.

It is very important for the sheet feeding apparatus to separate and feed sheets one by one to the image forming unit. In order to prevent the sheet feeding apparatus from feeding a plurality of sheets at the same time (double feeding), various types of feeding methods have been proposed.

In recent years, importance has been attached not only to stable feeding by preventing the double feeding, but also to downsizing of the sheet feeding apparatus. Furthermore, the image forming unit requires to be further downsized as a printer and a facsimile machine are used in a family.

Some image forming apparatuses including a sheet feeding cassette or a sheet feeding tray for storing sheets are provided with a feeding roller capable of forwardly or reversely rotating at the upper part of the sheet feeding tray, for example, to downsize the image forming apparatus.

When a sheet is fed, the sheet feeding apparatus reversely rotates the feeding roller to reversely transport the sheet in the sheet feeding tray and causes the trailing edge of the sheet to abut on the rear wall of the sheet feeding tray, thereby temporarily curving the uppermost sheet to be separated from other sheets.

After the uppermost sheet is temporarily curved, the feeding roller is forwardly rotated to send the uppermost sheet along the upper face of a separation claw provided downstream in the sheet feeding direction in the sheet feeding tray, thereby separating and feeding sheets one by one. Such a configuration allows the function of separating and feeding sheets to fall within the range where the sheet feeding tray is attached as discussed in Japanese Patent Application Laid-Open No. 05-147752.

In recent years, it has become important to stably feed various types of paper different in thickness. It often becomes problematic to feed a thin sheet which is low in stiffness in particular. A method for increasing apparent stiffness of a sheet by curving a sheet in a sheet feeding cassette, for example, to feed such a thin sheet low in stiffness.

As such a method, there is a method in which a sheet stored in a sheet support portion for stacking sheets, for example, is curved in the direction orthogonal to the feed direction of the sheet to increase apparent stiffness with respect to the feed direction of the sheet.

If the sheet is loosened by a sloping surface, increasing the apparent stiffness allows the sheet to be surely loosened even if the sheet is thin and the double feeding to be prevented. The technique is discussed in Japanese Patent Application Laid-Open No. 2000-143002.

In such a conventional sheet feeding apparatus, in a method for separating sheets in such a manner that the sheet is caused to climb up the separation claw, however, for a thin sheet low in stiffness in particular, when the sheet climbs up the separation claw, the leading end of the sheet collides with the edge face of the separation claw and may be broken. For a sheet high in stiffness, the leading end of the sheet catches the separation claw, resultantly, cannot climb up the separation claw, and may be jammed.

Then, as described above, the apparent stiffness of the sheet is increased in such a manner that the sheet is curved in the direction orthogonal to the feed direction of the sheet to allow preventing the leading end of the sheet from being broken, and allow the sheet to easily pass on the separation claw.

When the sheet high in apparent stiffness is curved by rotating the feeding roller in the direction opposite to the feed direction, the feeding roller may slip when the curve produced by reversely transporting the sheet is formed not to allow the sheet to be reversely transported.

When the uppermost sheet is curved by rotating the feeding roller in the direction opposite to the feed direction to cause the trailing edge of the sheet to abut on the rear wall of the sheet feeding tray, a buckle may occur at the trailing edge of the sheet because the sheet is high in apparent stiffness, which may not form warping in the sheet.

SUMMARY OF THE INVENTION

The present invention is directed to a sheet feeding apparatus and an image forming apparatus capable of stably separating and feeding a sheet.

According to an aspect of the present invention, a sheet feeding apparatus includes a sheet support portion configured to support a plurality of sheets, a forwardly or reversely rotatable feeding roller configured to send out an uppermost sheet among the sheets, a separation claw provided with pressing portions configured to press both ends of a sheet supported by the sheet support portion in the width direction thereof orthogonal to a direction in which the sheet is fed, and configured to separate the uppermost sheet by forwardly or reversely rotating of the feeding roller, a curvature formation portion configured to form curvature so that both ends in a width direction of the sheet supported by the sheet support portion become lower than a center portion thereof and a control unit configured to control the feeding roller and the curvature formation portion to rotate the feeding roller in a direction opposite to the direction in which the sheet is fed, to draw out the uppermost sheet from the separation claw, move the separation claw so that the pressing portions lie at a position separated from and lower than the uppermost sheet, and rotate the feeding roller in the direction in which the sheet is fed.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
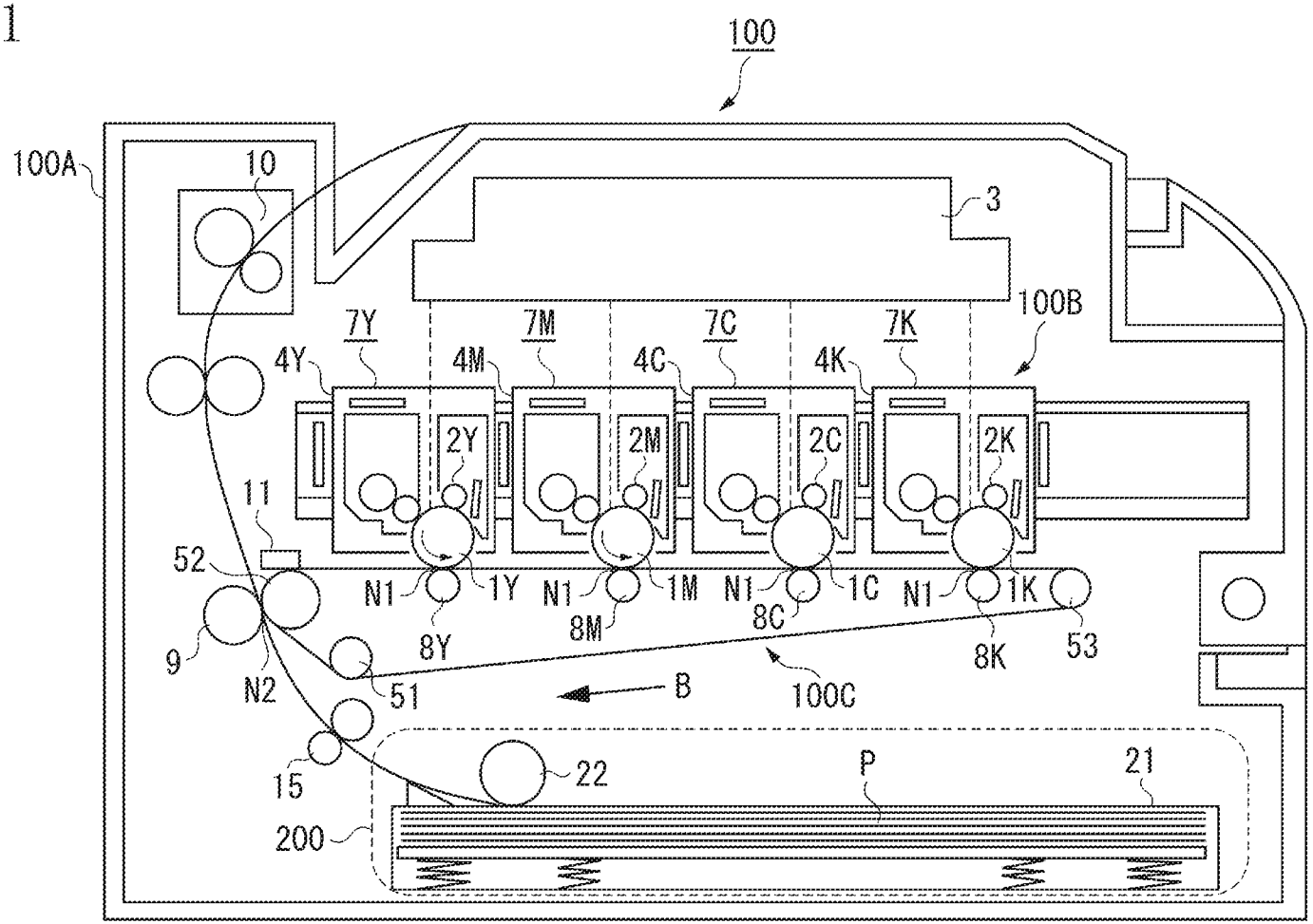
FIG. 1 is a schematic diagram illustrating an entire configuration of a full color laser printer as an example of an image forming apparatus including a sheet feeding apparatus according to a first exemplary embodiment of the present invention.

FIG. 1 is a schematic diagram illustrating an entire configuration of a full color laser printer as an example of an image forming apparatus including a sheet feeding apparatus according to a first exemplary embodiment of the present invention.

FIG. 1 includes a full color laser printer 100 and a full color laser printer main body 100A (hereinafter referred to as printer main body). The printer main body 100A being the image forming apparatus main body includes an image forming unit 100B for forming an image on a sheet such as recording paper, plastic sheet, and a cloth, and a sheet feeding apparatus 200 for feeding the sheets.

The image forming unit 100B includes a process cartridge 7 (7Y, 7M, 7C, and 7K) for forming toner images in four colors, yellow, magenta, cyan, and black. The process cartridge 7 includes a photosensitive drum 1 (1Y, 1M, 1Y, and 1K) serving as an image bearing member rotationally driven in the direction indicated by an arrow (counterclockwise direction) by a driving unit (driving source) (not illustrated) and is detachably attached to the printer main body 100A.

The image forming unit 100B also includes a scanner unit 3 arranged at an upper portion perpendicular to the process cartridge 7 and irradiates the photosensitive drum 1 with a laser beam based on image information to form an electrostatic latent image on the photosensitive drum 1. The process cartridge 7 includes a development unit 4 (4Y, 4M, 4C, and 4K) for adhering toner on the electrostatic latent image to visualize the electrostatic latent image as a toner image and a charging roller 2 (2Y, 2M, 2C, and 2K) for uniformly charging the surface of the photosensitive drum 1 as well as the photosensitive drum 1.

In FIG. 1, an intermediate transfer belt unit 100C includes an endless intermediate transfer belt 5 and a primary transfer roller 8 (8Y, 8M, 8C, and 8K) arranged inside the intermediate transfer belt 5 facing the photosensitive drum 1. The intermediate transfer belt 5 is stretched around a drive roller 53, a secondary transfer opposing roller 52, and a driven roller 51, and rotated in the direction indicated by an arrow B while abutting on all photosensitive drums 1.

The primary transfer roller 8 presses the intermediate transfer belt 5 against the photosensitive drum 1 to form a primary transfer portion N1 where the intermediate transfer belt 5 abuts on the photosensitive drum 1. A bias application unit (not illustrated) applies transfer bias to the intermediate transfer belt 5.

A primary transfer bias is applied to the intermediate transfer belt 5 by the primary transfer roller 8 and a toner image in each color on the photosensitive drum 1 is sequentially transferred to the intermediate transfer belt 5 to form a full color image on the intermediate transfer belt 5.

A secondary transfer roller 9 which presses the secondary transfer opposing roller 52 via the intermediate transfer belt 5 to form a secondary transfer portion N2 is arranged in a position opposing the secondary transfer opposing roller 52 on the outer peripheral surface side of the intermediate transfer belt 5. A secondary transfer bias power supply (a high voltage power supply) serving as a secondary transfer bias application unit (not illustrated) applies a bias having a polarity opposite to the normal charge polarity of the toner to the secondary transfer roller 9. Thereby, the toner image on the intermediate transfer belt 5 is transferred (secondary transferred) to the sheet P.

The sheet feeding apparatus 200 includes a sheet feeding cassette 21 which is detachably attached to the printer main body 100A and a feeding roller 22 for feeding a plurality of sheets P stored in the sheet feeding cassette 21. When the sheet P stored in the sheet feeding cassette 21 is fed, the feeding roller 22 pressed by the sheet P is rotated to send out the sheet P.

The image formation operation of the thus configured full color laser printer 100 is described below.

When an image signal is input to the scanner unit 3 from an image reading apparatus (not illustrated) connected to the printer main body 100A or a host apparatus such as a personal computer, the scanner unit 3 irradiates the photosensitive drum 1 with a laser beam corresponding to the image signal.

The photosensitive drum 1 whose surface is uniformly and previously charged with a predetermined polarity and potential by the charging roller 2 is irradiated with the laser beam by the scanner unit 3 to form the electrostatic latent image on the surface thereof. Thereafter, the electrostatic latent image is developed by the development unit 4 to visualize the image.

For example, the photosensitive drum 1Y is irradiated with the laser beam corresponding to the image signal in yellow component color by the scanner unit 3 to form a yellow electrostatic latent image on the photosensitive drum 1Y. The yellow electrostatic latent image is developed by a yellow tonner from the development unit 4Y to visualize the image as a yellow tonner image.

After that, the toner image arrives at the primary transfer portion N1 where the photosensitive drum 1Y abuts on the intermediate transfer belt 5 as the photosensitive drum 1Y is rotated. In the primary transfer portion N1, the yellow tonner image on the photosensitive drum is transferred to the intermediate transfer belt 5 by the primary transfer bias applied to the primary transfer roller 8Y.

When a portion bearing the yellow toner image on the intermediate transfer belt 5 is moved, a magenta toner image formed on the photosensitive drum 1M in the method similar to the above one until then is transferred onto the yellow toner image on the intermediate transfer belt 5.

Similarly, as the intermediate transfer belt 5 is moved, in the primary transfer portion, cyan and black toner images are superimposed on and transferred onto the yellow and the magenta toner images. Thereby, the full color toner image is formed on the intermediate transfer belt 5.

Along with the toner image formation operation, the sheet P stored in the sheet feeding cassette 21 is sent out by the feeding roller 22 and conveyed to a registration roller 15. The sheet P conveyed to the registration roller 15 is subjected to timing adjustment by the registration roller 15 and conveyed to a secondary transfer portion N2.

A bias having a positive polarity is applied to the secondary transfer roller 9 in the secondary transfer portion N2 to secondary transfer four-color toner images on the intermediate transfer belt 5 to the conveyed sheet P. The toner remained on the intermediate transfer belt 5 after the secondary transfer of the toner images is removed by a belt cleaner 11.

The sheet P to which the toner images are transferred is conveyed to a fixing portion 10 and heated and pressed, thereby fixing the full color toner image as a permanent image. After that, the image is discharged outside the printer main body 100A.

A sheet feeding apparatus 200 according to the present exemplary embodiment is described with reference to FIGS. 2, 3A, and 3B. The feeding roller 22 for feeding the sheet P is arranged in a central portion in the widthwise direction orthogonal to the sheet feeding direction of sheet support portions 25 and 26 for supporting a plurality of sheets. The feeding roller 22 is fixed to a drive shaft 31 connected to a sheet feeding motor PM capable of forwardly or reversely rotating, described below and illustrated in FIG. 4.

Figure 2:
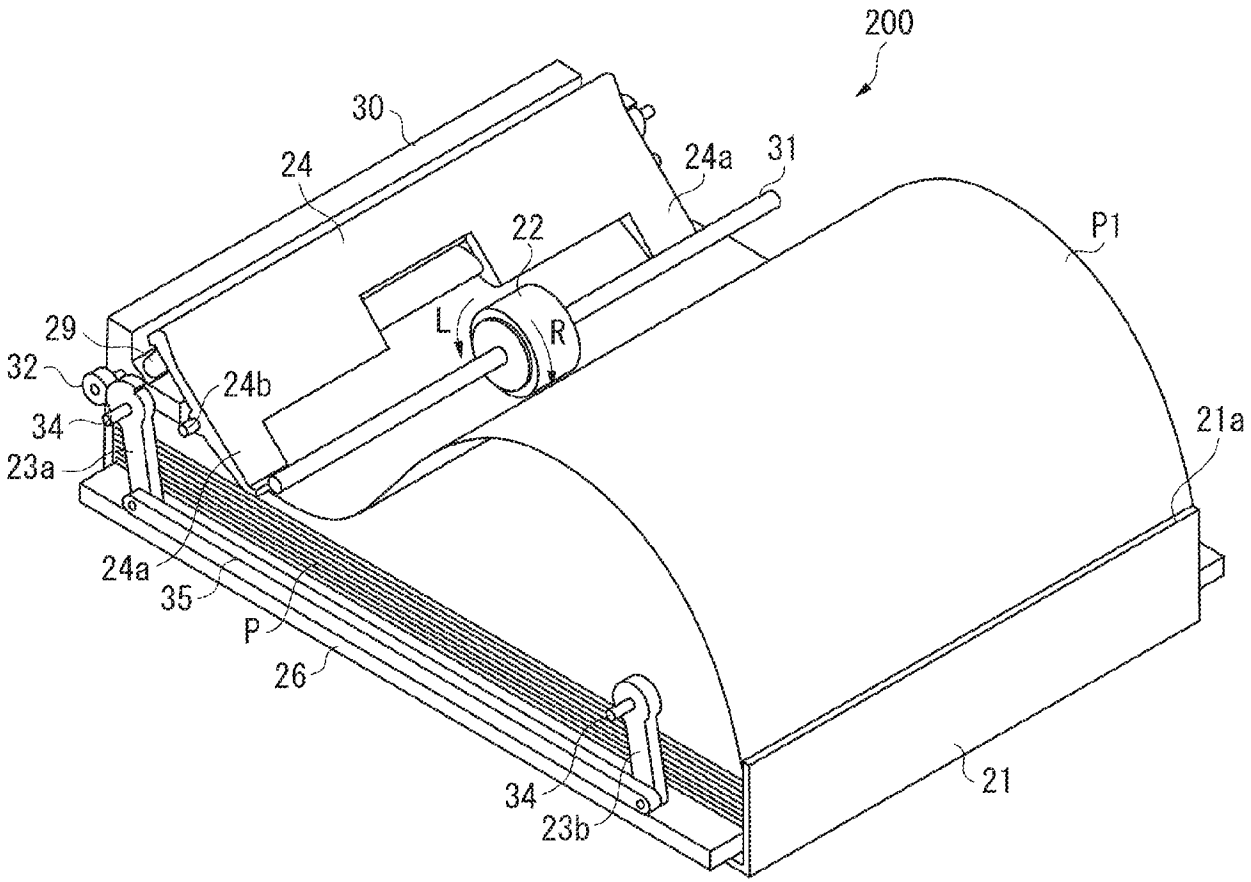
FIG. 2 is a diagram illustrating a configuration of the sheet feeding apparatus.
Figure 3A:
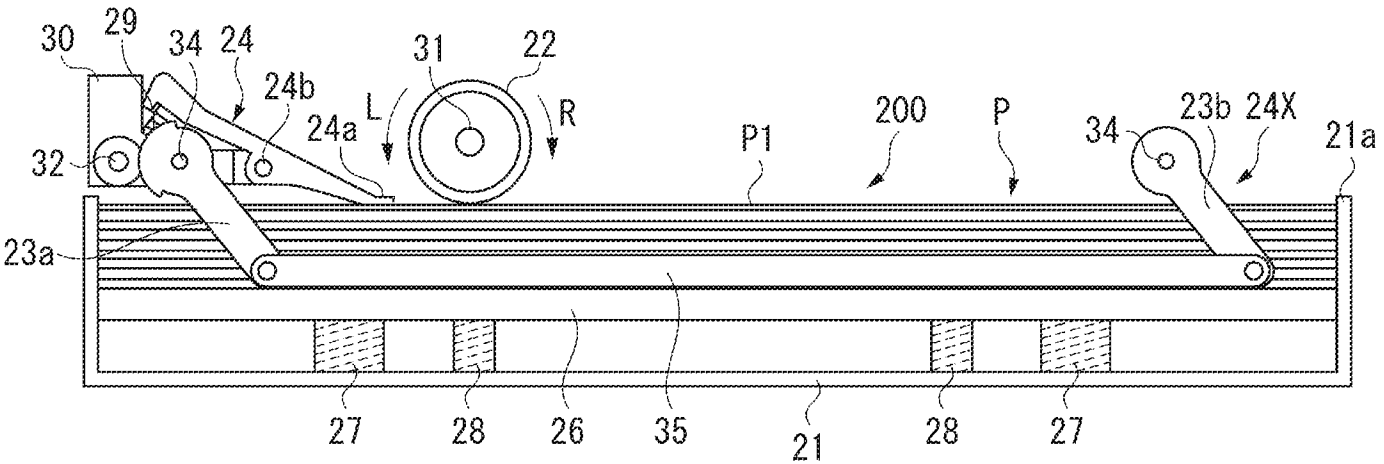
FIGS. 3A and 3B are diagrams illustrating a configuration of the sheet feeding apparatus.

The feeding roller 22 is capable of rotating in the direction, in which the sheet is fed, indicated by an arrow R and in the direction opposite to the direction, in which the sheet is fed, indicated by an arrow L in FIGS. 2 and 3A, by receiving driving force from the sheet feeding motor PM.

The feeding roller 22 rotates in the direction indicated by the arrow R to feed the sheet to the upper left direction illustrated in FIG. 1. The direction in which the sheet is fed is the sheet feeding direction. The direction in which the sheet is moved to the right direction in FIG. 1 by the rotation of the feeding roller 22 in the direction indicated by the arrow L is the sheet reverse feeding direction.

A separation claw 24 is rotatably provided on a separation claw base 30 disposed downstream in the sheet feed direction of the feeding roller 22 in the sheet feeding cassette 21 stacked with sheets with a rotary axis 24*b* as a fulcrum.

The separation claw 24 is provided with pressing portions 24*a* which are provided at both side ends of the widthwise direction orthogonal to the sheet feeding direction and presses both ends in the widthwise direction of the sheet P and urged by a compression spring 29, so that the pressing portions 24*a* abut on the sheet.

In the sheet feeding apparatus 200 with this configuration, when the sheet P is fed, the feeding roller 22 is rotated in the reverse feeding direction to reversely transport the uppermost sheet P1 of the sheets P stacked on the sheet feeding cassette 21.

A curvature is formed by reversely transporting the uppermost sheet P1 to separate the uppermost sheet P1 from the second and subsequent sheets under the uppermost sheet P1, and then the feeding roller 22 is rotated in the sheet feed direction to feed the uppermost sheet P1. The uppermost sheet P1 passes on the upper surface of the separation claw 24 and fed in a predetermined feeding direction positioned in the upper portion of the separation claw 24.

In the present exemplary embodiment, the separation claw 24 is made of a low friction material such as polyoxymethylene (POM), so that the end of the uppermost sheet P1 in the sheet feed direction (hereinafter referred to as leading end) can be smoothly drawn from the separation claw 24 when the uppermost sheet P1 is reversely transported.

Figure 3B:
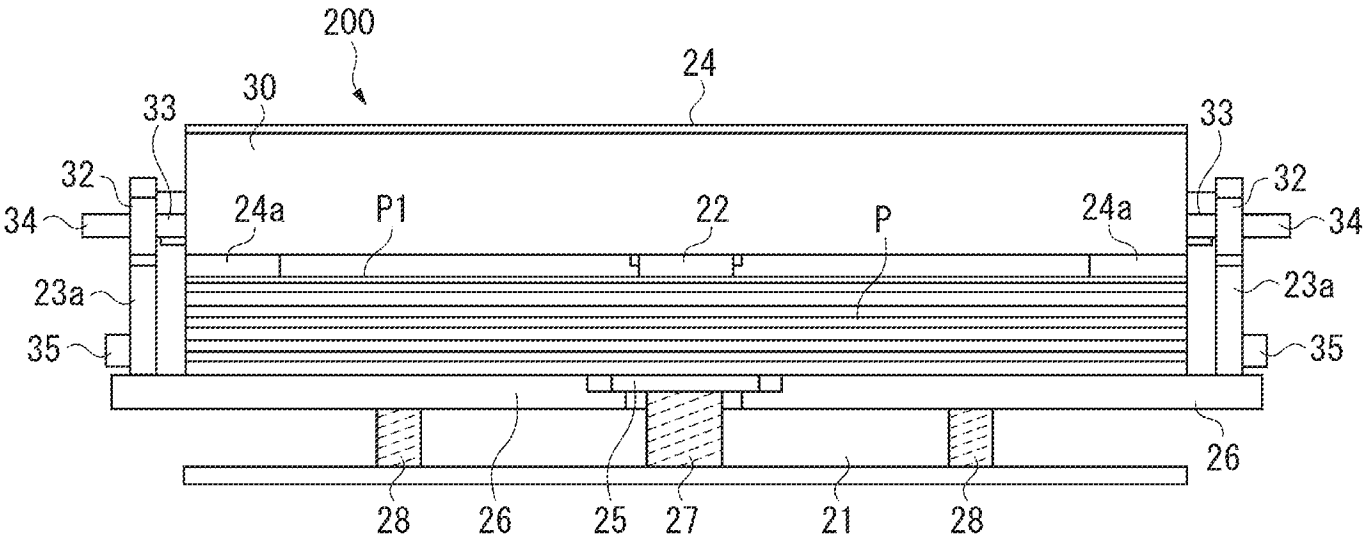

As illustrated in FIG. 3B, the sheet feeding cassette 21 is provided with a center base plate 25 serving as a center supporting portion for supporting the center portion in the widthwise direction of the sheet P. The sheet feeding cassette 21 is provided with a side base plate 26 serving as a both-end supporting portion which is located on both sides in the widthwise direction of the center base plate 25, separated from the center base plate 25, and is relatively elevatable. The center base plate 25 and the side base plate 26 form a sheet supporting portion for supporting the sheet.

The center base plate 25 and the side base plate 26 are urged respectively by compression springs 27 and 28 against the feeding roller 22. This causes the sheet P stacked on the sheet feeding cassette 21 to abut on the feeding roller 22. The compression springs 27 and 28 are set to a suitable spring constant so that the sheet P is stably urged against the feeding roller 22 according to the stacked sheet P.

The configuration of a curvature formation portion 24X characterized by the present invention is described below. On both sides of the sheet feeding cassette 21 there are provided depression levers 23*a* and 23*b* for depressing the side base plate 26 by depressing the side ends of the side base plate 26 for the sheet downward. The depression levers 23*a* and 23*b* are coupled with a coupling bar 35.

The depression levers 23*a* and 23*b* are rotatably supported by shafts 34. The depression levers 23*a* and 23*b* and the coupling bar 35 form a link mechanism.

The depression lever 23*a* is rotated with the rotation of a gear 32 fixed to a gear shaft 33 rotated by the driving force of a drive motor WM illustrated in FIG. 4 described below, and depresses the side base plate 26 along with the depression lever 23*b* via the coupling bar 35.

When the side base plate 26 is depressed by the depression levers 23*a* and 23*b*, the center base plate 25 is maintained at a position where the sheet P is urged against the feeding roller 22 by the compression spring 27, so that only the side base plate 26 is depressed.

Figure 4:
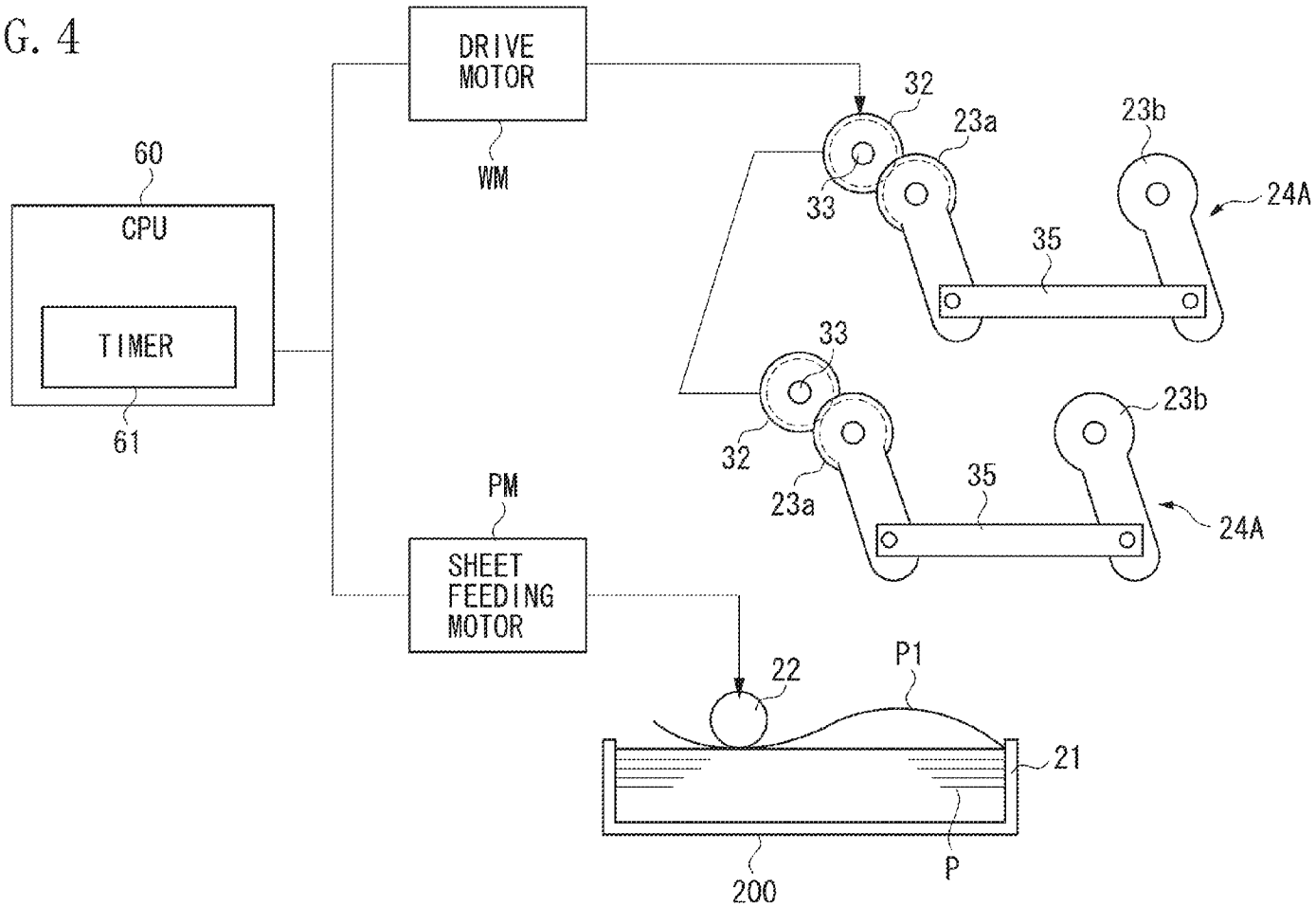
FIG. 4 is a control block diagram of the sheet feeding apparatus.

FIG. 4 is a control block diagram for a drive system of the sheet feeding apparatus 200. In FIG. 4, a central processing unit (CPU) 60 serving as a control unit controls the sheet feeding motor PM and the drive motor WM. A timer 61 is incorporated in the CPU 60.

The side base plate 26 is depressed by the depression levers 23*a* and 23*b* to produce a step between the side base plate 26 and the center base plate 25. The step depresses both the left and the right ends of the sheet to curve the sheet. The pressing portions 24*a* of the separation claw 24 arranged at both ends of the sheet follow the upper surface at both ends of the sheet due to the elastic force of the compression spring 29 while pressing the upper surface, and move.

Figure 7:
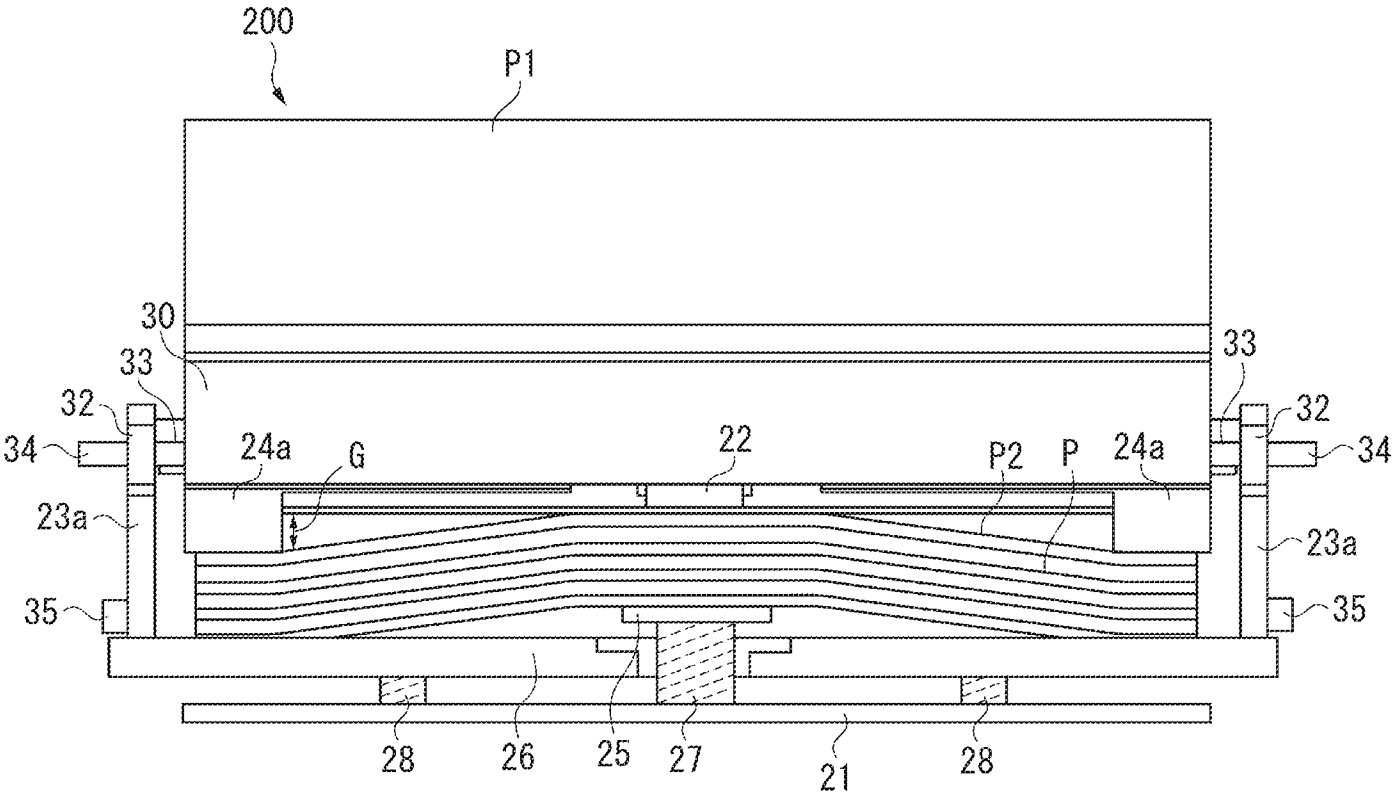
FIG. 7 is a diagram illustrating the sheet feeding operation of the sheet feeding apparatus.

As illustrated in FIG. 7, in this state, all of the second and subsequent sheets P2 under the uppermost sheet P1 are high in their center portion in the direction orthogonal to the sheet feeding direction and are curved to lower both the left and right ends. In the present exemplary embodiment, the curvature formation portion 24X is formed of the depression levers 23*a* and 23*b* and the drive motor WM.

Figure 5:
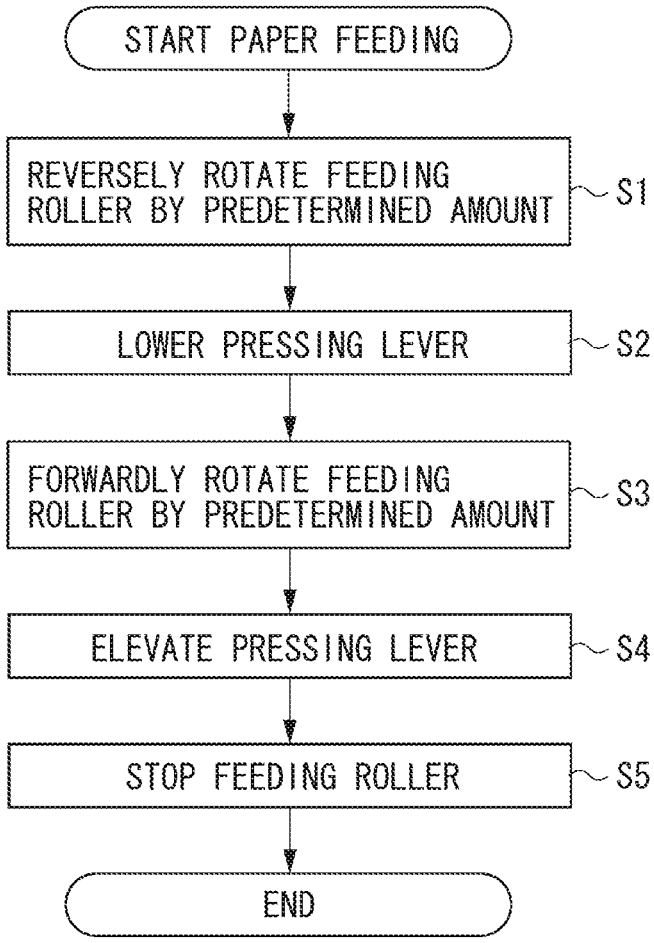
FIG. 5 is a flow chart illustrating a sheet feeding operation of the sheet feeding apparatus.

The sheet feeding operation of the sheet feeding apparatus 200 performed by the CPU (control unit) 60 is described below with reference to a flow chart illustrated in FIG. 5, an operation chart illustrated in FIGS. 6A, 6B, 7, and 8, and a timing chart illustrated in FIGS. 9A to 9C.

FIG. 3A already described above is a schematic diagram illustrating an initial state of the sheet feeding operation of the sheet feeding apparatus 200. At this point, the sheet P is stacked in the sheet feeding cassette 21 with the upper surface thereof flat. The sheet feeding operation starts with this state as an initial state.

In step S1, the CPU 60 reversely rotates the feeding roller 22 in the reverse feeding direction (in the direction indicated by the arrow L) by a predetermined amount. This operation reversely transports the leading end side of the uppermost sheet P1 and the leading end of the uppermost sheet P1 passes by the end of the pressing portion 24*a* of the separation claw 24 abutting on the sheet (hereinafter referred to as the front end of the pressing portion 24*a*).

In the present exemplary embodiment, the number of rotations of the feeding roller 22 (or the amount of conveyance of the sheet by which the leading end of the sheet can pass by the separation claw 24) is regulated by the time control of the timer 61 incorporated in the CPU 60. Other than that, the number of rotations (or the amount of conveyance of the sheet) may be controlled using a sensor.

The feeding roller 22 is reversely rotated to cause the uppermost sheet P1 fed in the reverse feeding direction to abut on a back end wall 21*a* of the sheet feeding cassette 21 and movement in the reverse feeding direction is regulated.

Figure 6A:
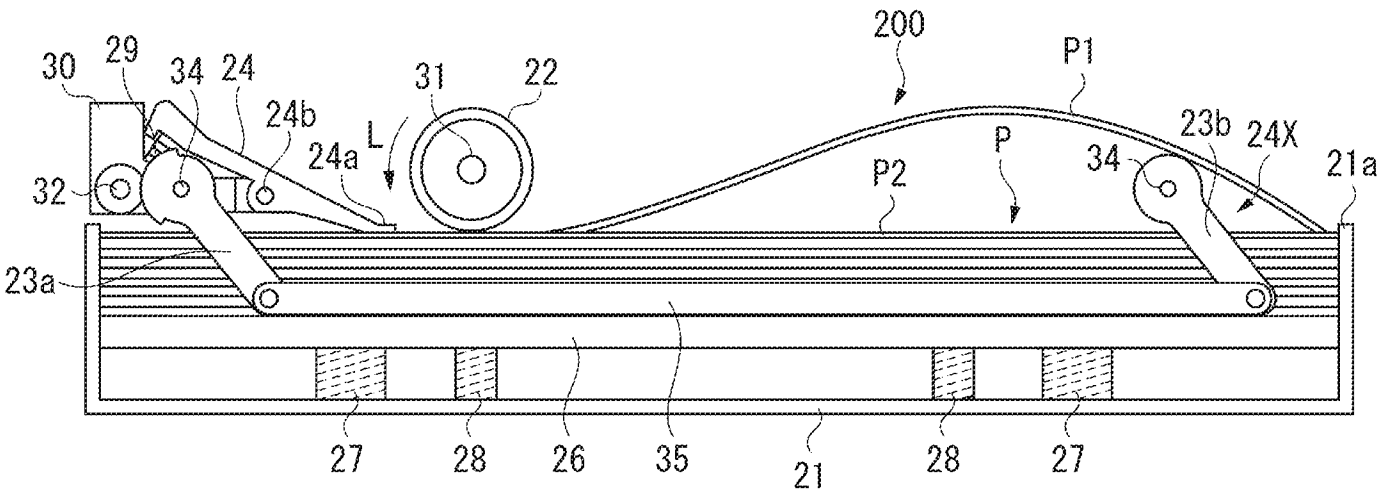
FIGS. 6A and 6B are diagrams illustrating the sheet feeding operation of the sheet feeding apparatus.

For this reason, as illustrated in FIG. 6A, the uppermost sheet P1 is curved between the feeding roller 22 and the back end wall 21*a* of the sheet feeding cassette 21. When the uppermost sheet P1 is thus conveyed, a second sheet underlying the uppermost sheet P1 may be conveyed by the force of friction with the uppermost sheet P1 and curved.

In the present exemplary embodiment, however, the spring constants of the compression springs 27 and 28 are adjusted so that the conveyance force applied to the second and subsequent sheets P2 via the uppermost sheet P1 becomes smaller than a force by which the second and subsequent sheets P2 are curved.

For this reason, when the uppermost sheet P1 is conveyed, the leading end of the second and subsequent sheets P2 will not pass by the front end of the pressing portion 24*a* of the separation claw 24. Therefore, only the uppermost sheet P1 is conveyed in the reverse feeding direction along the second and subsequent stacked sheets P2 and separated from the second and subsequent sheets P2.

Figure 6B:
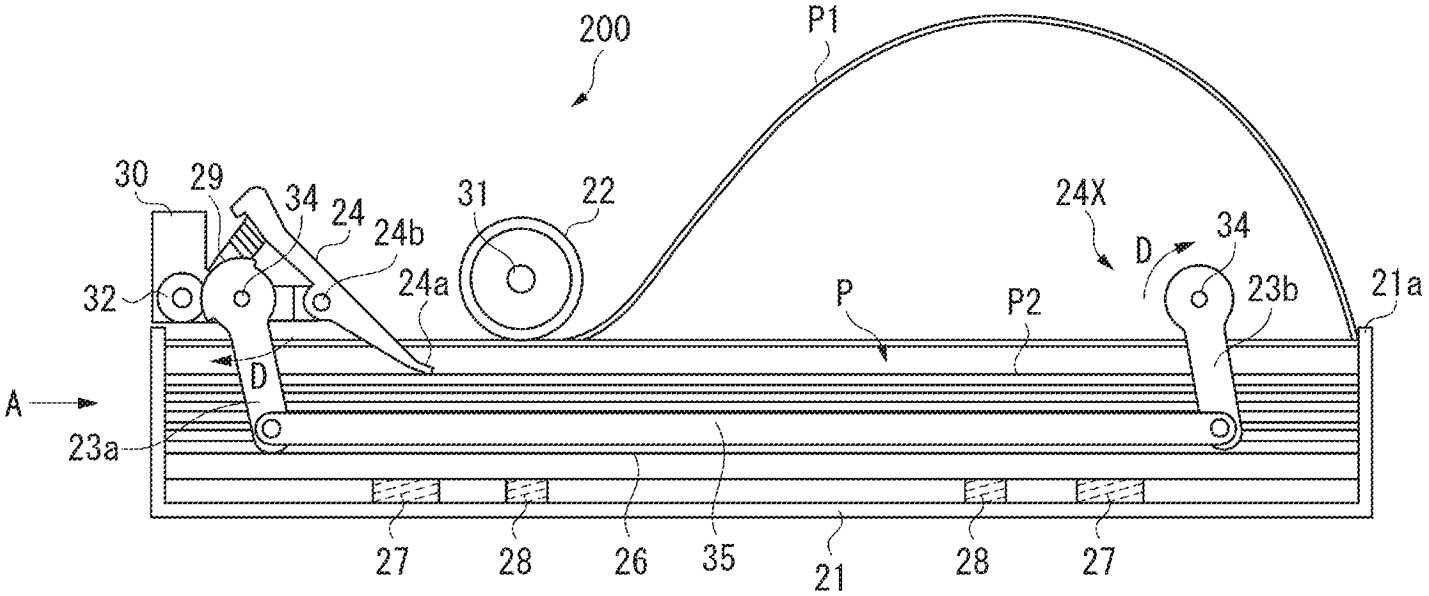

When the leading end of the uppermost sheet P1 passes by the front end of the pressing portion 24*a* of the separation claw 24, in step S2, as illustrated in FIG. 6B, the drive motor WM is driven to rotate the depression levers 23*a* and 23*b* in the direction indicated by the arrow D and lower the depression levers 23*a* and 23*b*. As illustrated in FIG. 7, the depression levers 23*a* and 23*b* are lowered to depress the side base plate 26.

When the side base plate 26 is depressed by the depression levers 23*a* and 23*b*, the height of the center base plate 25 remains unchanged, so that a step is produced between the center base plate 25 and the depressed side base plate 26. When the step is produced, the second and subsequent sheets P2 stacked in the sheet feeding cassette 21 are pressed by the separation claw 24 urged by the compression spring 29 against the top surface of the side base plate 26 in the direction in which the sheet P is depressed.

As a result, the second and subsequent sheets P2 are curved along the step produced between the center base plate 25 and the side base plate 26. In other words, the sheets are curved so that the center portion thereof is elevated and both left and right ends thereof are lowered in the direction orthogonal to the sheet feeding direction.

At this point, the uppermost sheet P1 is curved along the sheet feeding direction on its trailing edge side, so that the uppermost sheet P1 is hardly curved in the same direction as the direction in which the second and subsequent sheets P2 are curved as illustrated in FIG. 7, which is a diagram viewed from the direction indicated by an arrow A in FIG. 6B. Thus, the uppermost sheet P1 is curved along the sheet feeding direction and the second and subsequent sheets P2 are curved in the direction orthogonal to the sheet feeding direction to produce a gap G between the uppermost sheet P1 and the top surface of the second and subsequent sheets P2.

The front end of the pressing portion 24*a* of the separation claw 24 abuts on the top surface of the sheet P2, so that the gap G is also substantially produced between the uppermost sheet P1 and the front end of the pressing portion 24*a*. In other words, the uppermost sheet P1 is separated from the pressing portion 24*a* of the separation claw 24.

Figure 8:
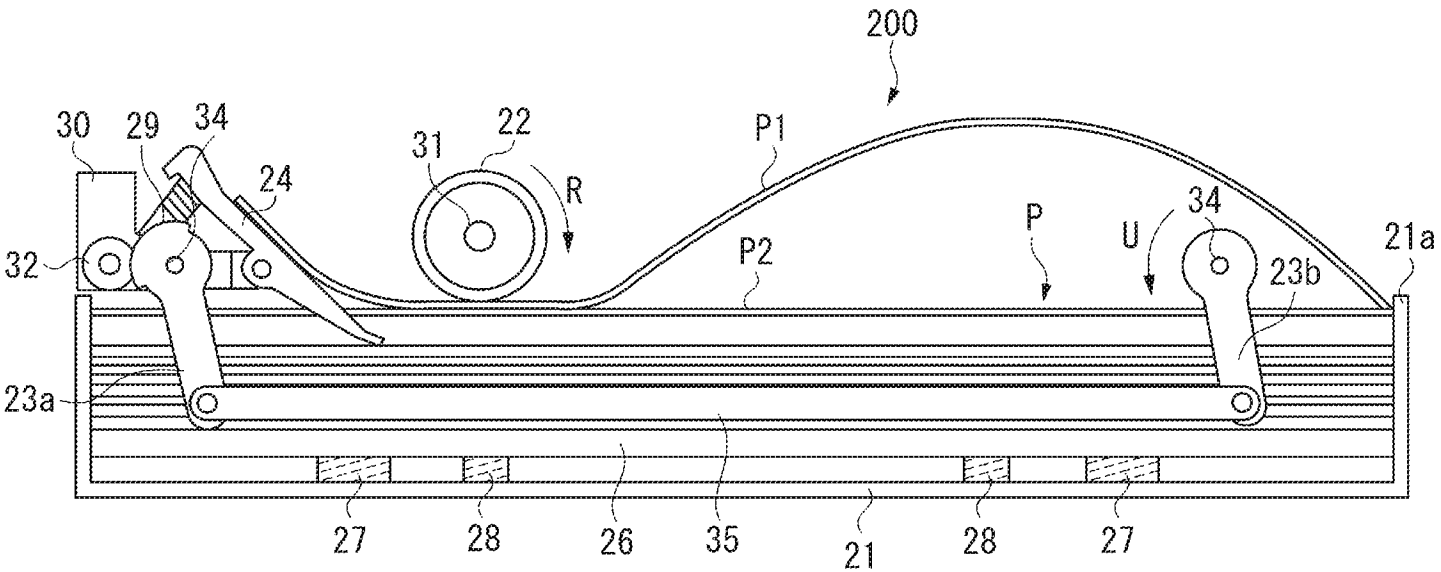
FIG. 8 is a diagram illustrating the sheet feeding operation of the sheet feeding apparatus.
Figures 9A, 9B, 9C:
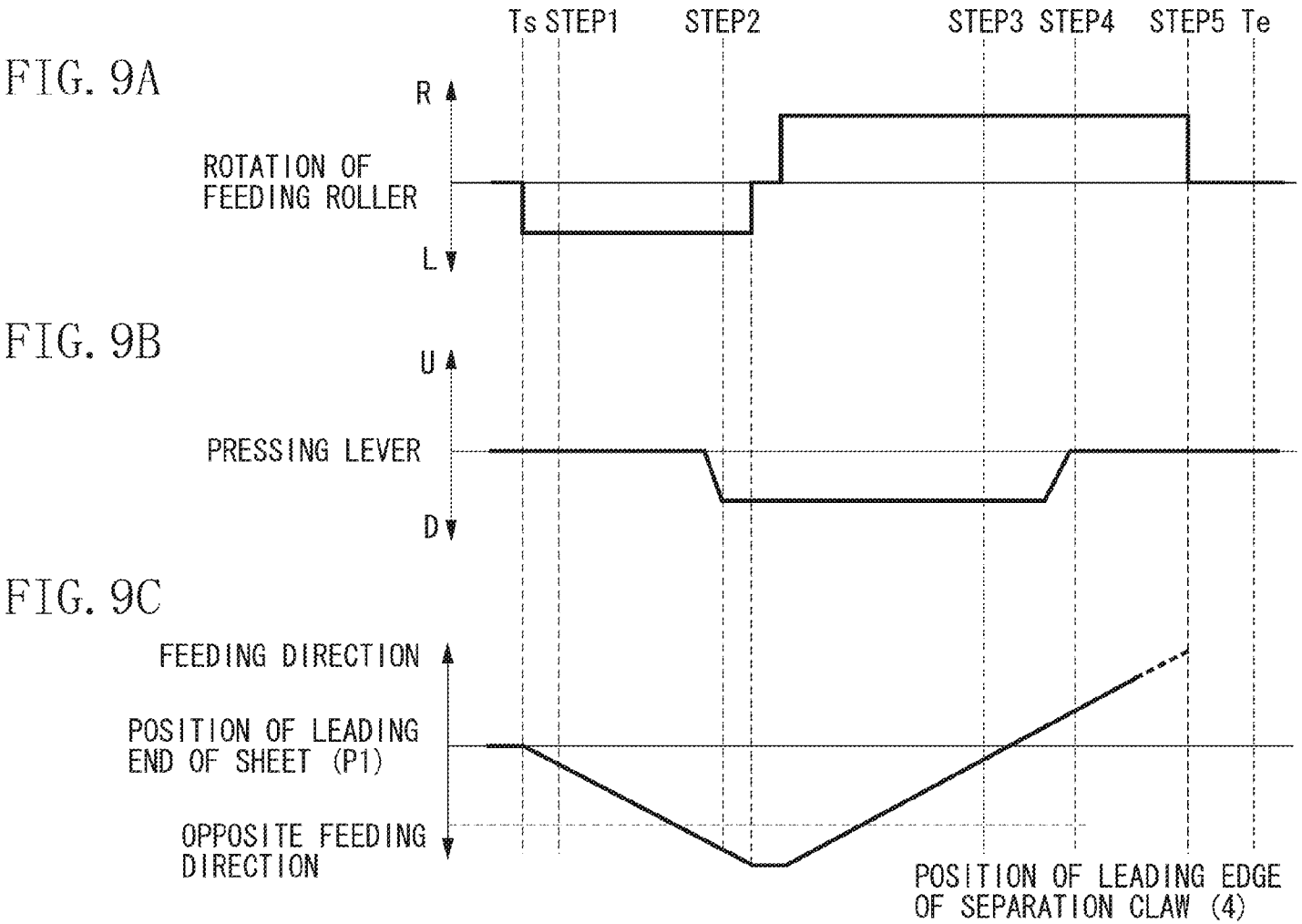
FIGS. 9A, 9B, and 9C are timing charts illustrating the sheet feeding operation of the sheet feeding apparatus.

As illustrated in FIG. 8, in step S3, the feeding roller 22 is forwardly rotated in the sheet feeding direction (in the direction indicated by the arrow R) by a predetermined amount to feed the upper sheet P1. As described above, the front end of the pressing portion 24*a* of the separation claw 24 is urged in the direction of the surface of the second and subsequent curved sheets P2, so that the leading end is lower in position than the uppermost sheet P1 and separated therefrom.

Therefore, the leading end of the reversely fed uppermost sheet P1 will not abut on the front end of the pressing portion 24*a* of the separation claw 24. Only the uppermost sheet P1 climbs up the top surface of the separation claw 24 to be sent out and is separated from the second and subsequent curved sheets P2 and fed.

When the uppermost sheet P1 climbs up the top surface of the separation claw 24 to be sent out, the drive motor WM is driven to rotate the depression levers 23*a* and 23*b* in the direction in which the depression of the side base plate 26 is released, that is, in the direction indicated by an arrow U in which the depression levers 23*a* and 23*b* are elevated.

Thereby, in step S4, the depression levers 23*a* and 23*b* are elevated, the depression of the side base plate 26 performed by the depression levers 23*a* and 23*b* is released, the side base plate 26 is also elevated, and the sheet P stacked in the sheet feeding cassette 21 returns to a flat state.

After that, in step S5, the separated uppermost sheet P1 is fed, and when the uppermost sheet P1 passes by the feeding roller 22, the drive of the feeding roller 22 is stopped. Thus, only the uppermost sheet P1 among the sheets P stacked in the sheet feeding cassette 21 is fed.

In this step, the sheet feeding apparatus 200 returns to the initial state illustrated in FIG. 3. By repeating steps S1 to S5, the second and subsequent curved sheets P2 are equentially fed.

As described above, in the present exemplary embodiment, both ends of the sheet in the direction orthogonal to the sheet feeding direction are curved downward when the sheet is fed and the separation claw 24 is moved so that the front end of the pressing portion 24*a* of the separation claw 24 becomes lower than the uppermost sheet P1.

This allows the uppermost sheet P1 to be surely fed along the top surface of the separation claw 24 without catching the front end of the pressing portion 24*a* of the separation claw 24 because the front end of the pressing portion 24*a* of the separation claw 24 is lower in position than the uppermost sheet P1, when the sheet is fed in the sheet feeding direction after the sheet is reversely fed. This allows the sheet to be stably separated and fed, and the sheet feeding apparatus to be downsized, and also allows the sheet to be stably fed without being broken and failing to be fed.

Figure 10:
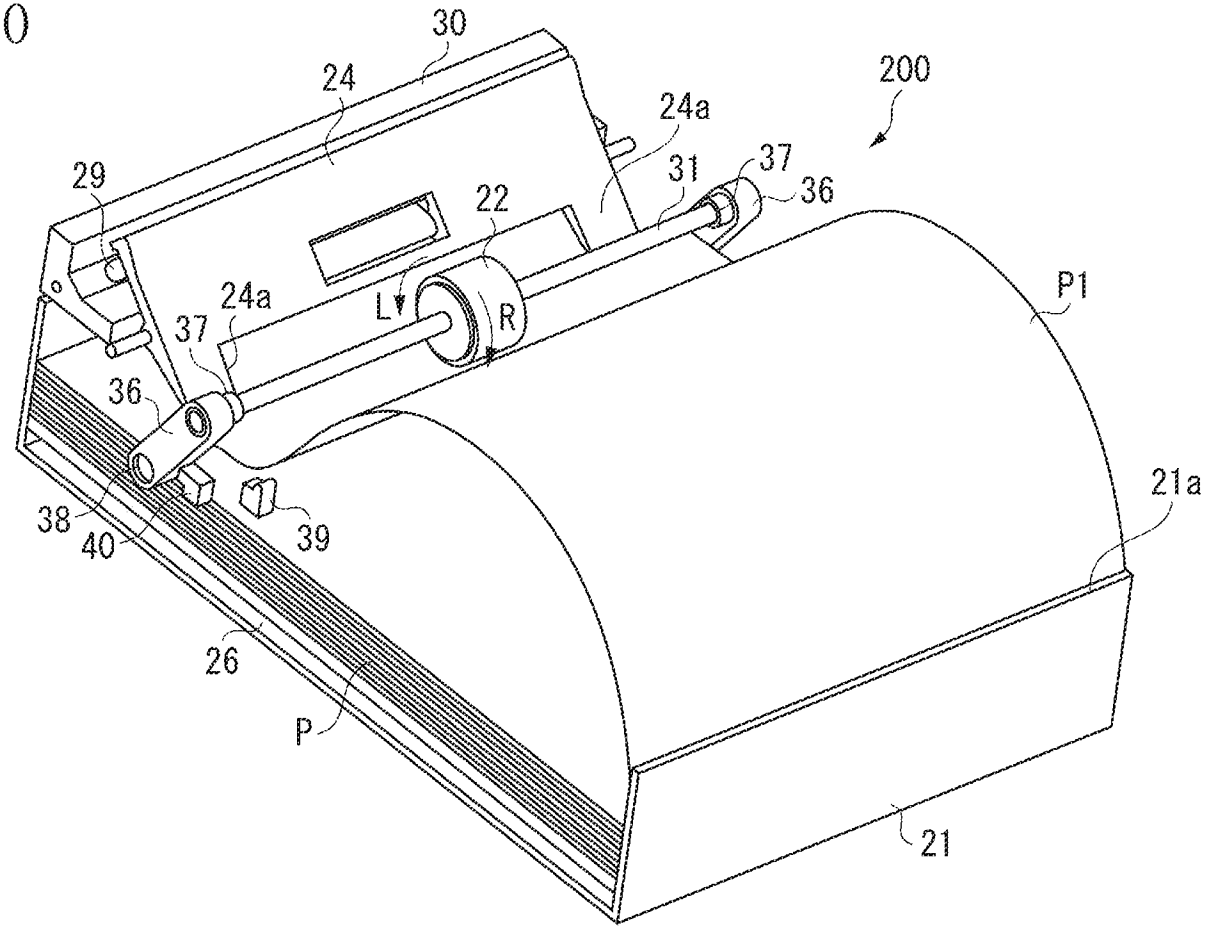
FIG. 10 is a perspective view illustrating a configuration of a sheet feeding apparatus according to a second exemplary embodiment of the present invention.

A second exemplary embodiment of the present invention is described below. FIG. 10 is a perspective view illustrating a configuration of a sheet feeding apparatus according to the present exemplary embodiment. In FIG. 10, the same reference numerals and characters as those in FIG. 2 represent the same or corresponding portions.

In FIG. 10, depression arms 36 are provided at both ends of the drive shaft 31 of the feeding roller 22 rotated by the sheet feeding motor PM illustrated in FIG. 4 via a bidirectional torque limiter 37.

The depression arms 36 are provided at both ends of the drive shaft 31 via the bidirectional torque limiter 37 to be rotated in the directions indicated by arrows L and R along with the drive of the feeding roller 22.

Rollers 38 are rotatably fixed to the tip ends of the depression arms 36 and arranged at positions where the rollers 38 abut on the top surface of both ends of the sheet P stacked in the sheet feeding cassette 21 in the direction orthogonal to the sheet feeding direction.

When the depression arm 36 is rotated in the direction indicated by the arrow L in FIG. 10, the roller 38 depresses downward the end of the sheet P stacked in the sheet feeding cassette 21 to curve the sheet P while depressing the side base plate 26. At this point, the center base plate 25 is not depressed and kept at a position where the sheet P is urged against the feeding roller 22.

Thus, in the present exemplary embodiment, the sheet is curved so that the central portion thereof is elevated and both ends thereof are lowered in the direction orthogonal to the sheet feeding direction. The front end of the pressing portion 24*a* of the separation claw 24 is moved to a position lower than the uppermost sheet along with the side end portion of the curved sheet.

The curvature formation portion in the present exemplary embodiment is formed of the depression arms 36, the drive shaft 31, and the sheet feeding motor PM. An upper stopper 39 and a lower stopper 40 regulate the rotation range of the depression arms 36, are arranged in a sheet feeding apparatus main body (not illustrated) formed of the printer main body 100A, and extended to the cassette side.

Figure 11:
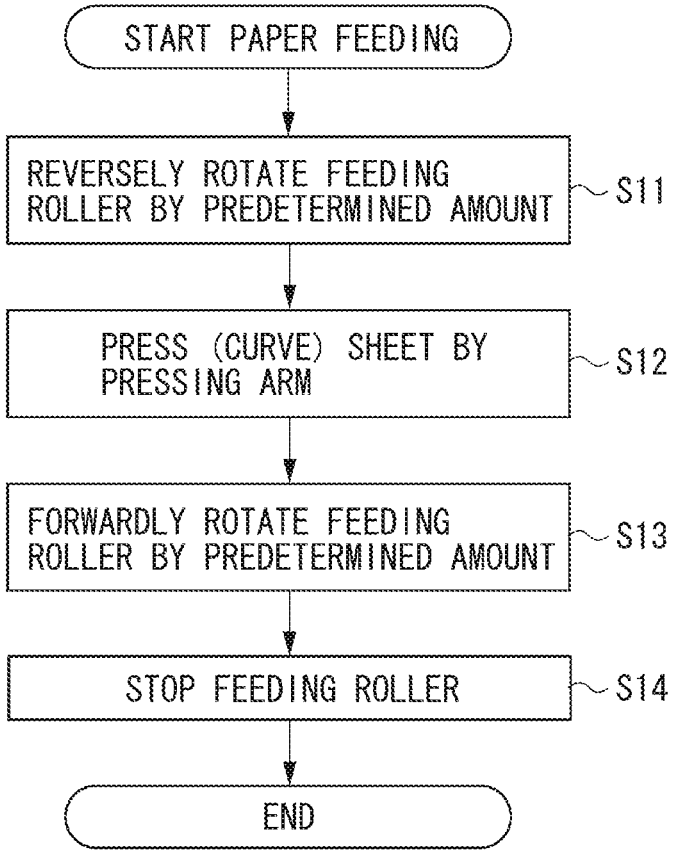
FIG. 11 is a flow chart illustrating a sheet feeding operation of the sheet feeding apparatus.

The sheet feeding operation of the thus configured sheet feeding apparatus 200 is described below with reference to a flow chart illustrated in FIG. 11, operation diagrams illustrated in FIGS. 12A, 12B, 13A, 13B, 14, and 15, and a timing chart illustrated in FIG. 16.

Figure 12A:
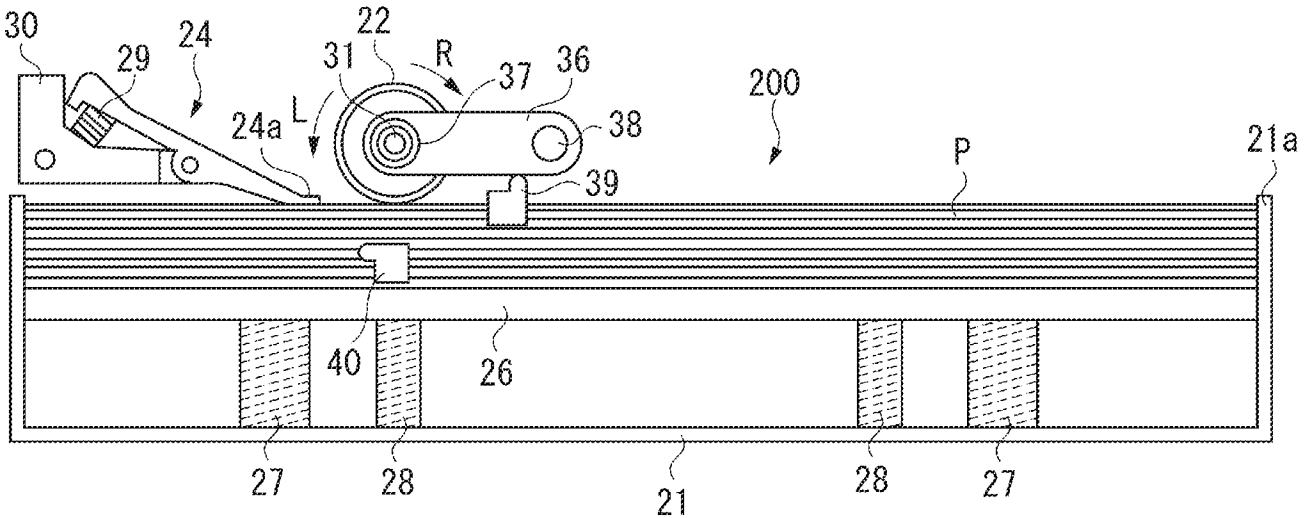
FIGS. 12A and 12B are diagrams illustrating the sheet feeding operation of the sheet feeding apparatus.
Figure 12B:
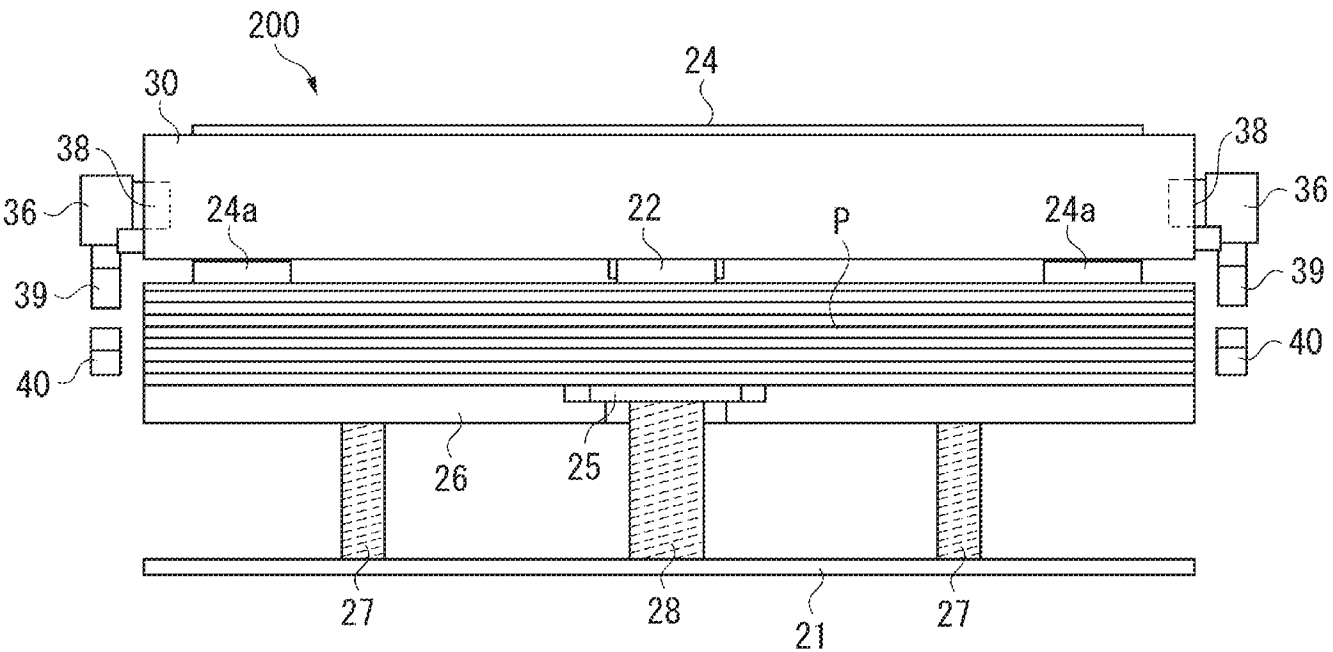

FIGS. 12A and 12B are diagrams illustrating an initial state of the sheet feeding operation of the sheet feeding apparatus 200. At this point, the sheet P is stacked in the sheet feeding cassette 21 with the upper surface thereof flat. The sheet feeding operation starts with this state as an initial state.

In step S11, the CPU 60 reversely rotates the feeding roller 22 in the reverse feeding direction (in the direction indicated by the arrow L) by a predetermined amount. In step S11, the feeding roller 22 continues rotating until the leading end of the uppermost sheet P1 passes by the front end of the pressing portion 24*a* of the separation claw 24. In the present exemplary embodiment, the number of rotations of the feeding roller 22 (or the amount of conveyance of the sheet) is regulated by time control of the timer 61 in the CPU 60.

Figure 13A:
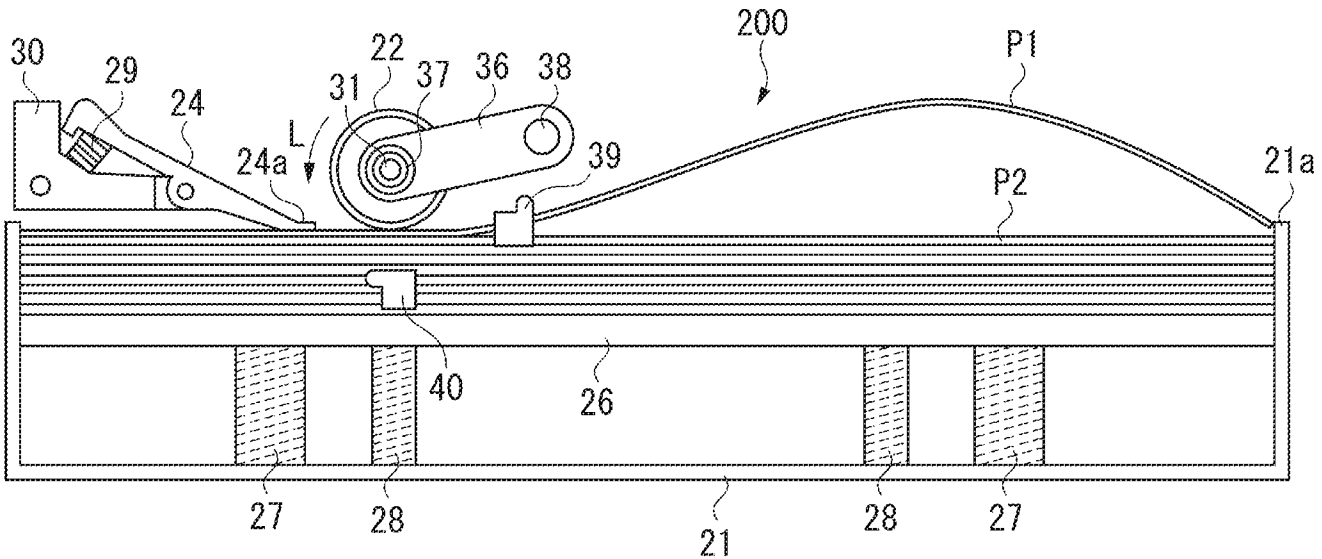
FIGS. 13A and 13B are diagrams illustrating the sheet feeding operation of the sheet feeding apparatus.

The feeding roller 22 is reversely rotated to cause the uppermost sheet P1 to be fed in the reverse feeding direction to abut on the back end wall 21*a* of the sheet feeding cassette 21, and movement in the reverse feeding direction is regulated. For this reason, as illustrated in FIG. 13A, the uppermost sheet P1 is curved between the feeding roller 22 and the back end wall 21*a* of the sheet feeding cassette 21 to separate the uppermost sheet P1 from the second and subsequent sheets P2.

The feeding roller 22 still continues rotating. When the leading end of the uppermost sheet P1 passes by the front end of the pressing portion 24*a* of the separation claw 24, in step S12, the depression arm 36 rotated along with the feeding roller 22 presses downward the second and subsequent sheets P2. This depresses the second and subsequent sheets P2 and the side base plate 26 to curve all of the second and subsequent sheets P2.

Figure 13B:
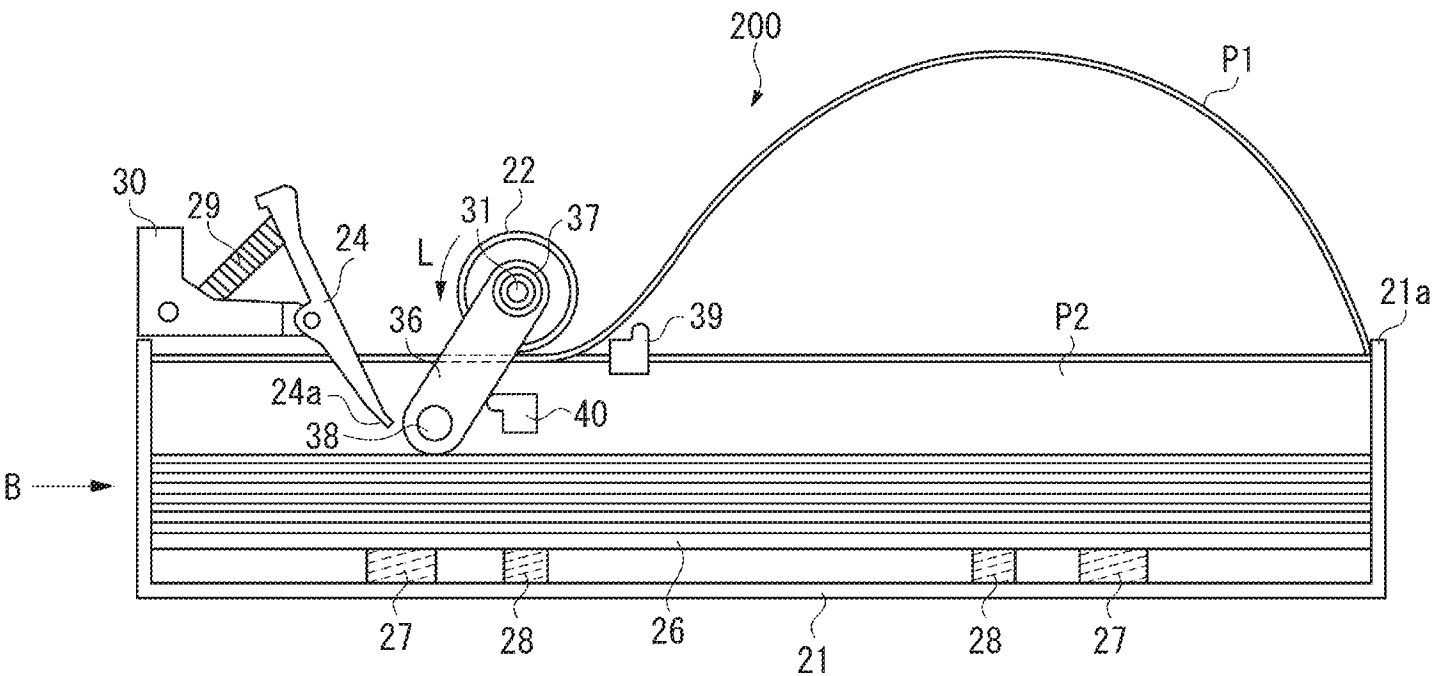

After that, as illustrated in FIG. 13B, the depression arm 36 abuts on the lower stopper 40 and then stops rotating.

As described above, the depression arm 36 is attached to the drive shaft 31 via the bidirectional torque limiter 37, so that, even if the feeding roller 22 continues rotating, the transmission of rotation to the depression arm 36 is shut off to stop only the depression arm 36. The feeding roller 22 continues rotating by a predetermined amount even after the leading end of the uppermost sheet P1 passes by the front end of the pressing portion 24*a* of the separation claw 24.

When the side base plate 26 is depressed, the height of the center base plate 25 remains unchanged, so that a step is produced between the side base plate 26 depressed by the depression arm 36 via the sheet P and the center base plate 25. Thereby, the second and subsequent sheets P2 stacked in the sheet feeding cassette 21 are curved along the step produced between the center base plate 25 and the side base plate 26.

Figure 14:
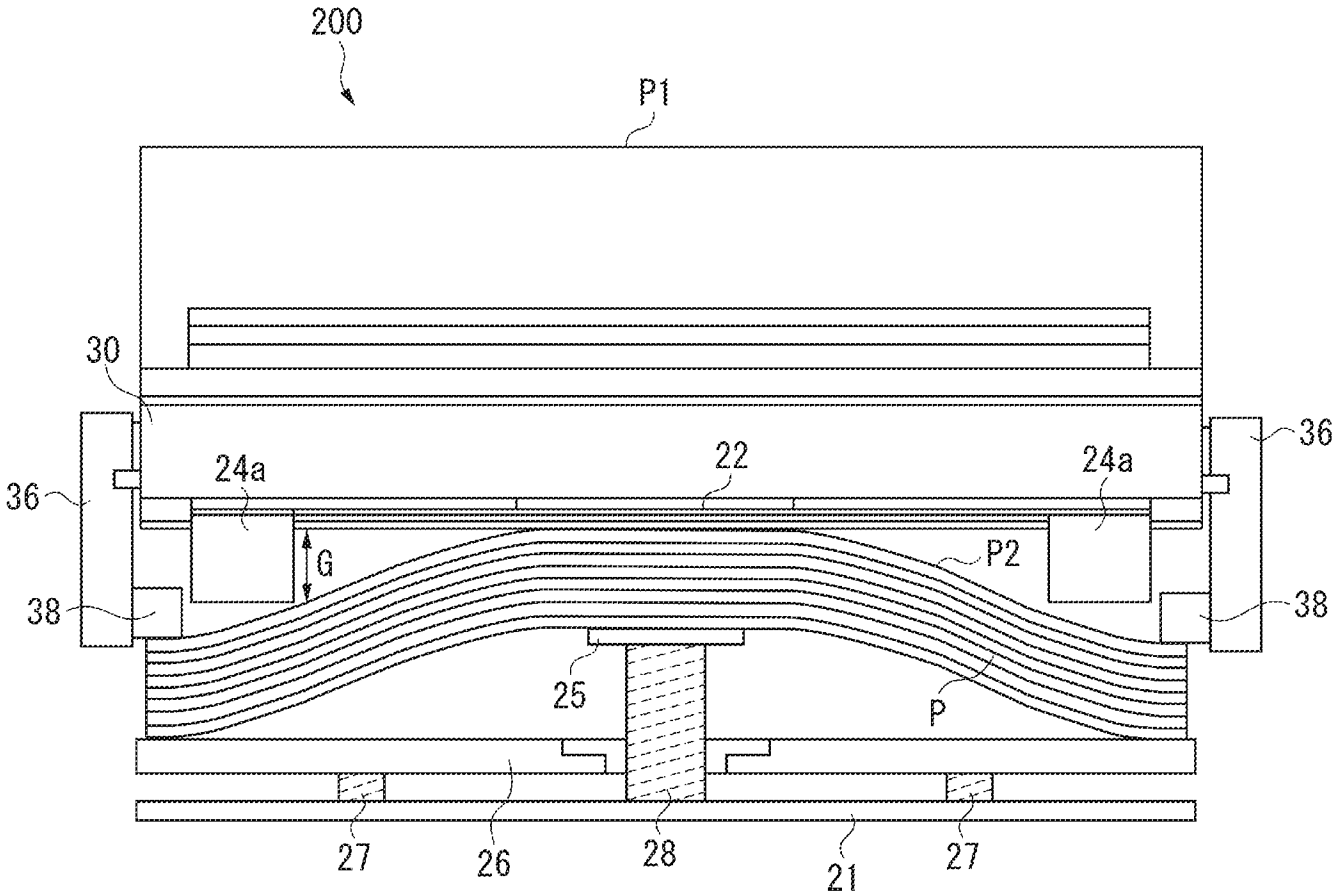
FIG. 14 is a diagram illustrating the sheet feeding operation of the sheet feeding apparatus.

At this point, as illustrated in FIG. 13B, the uppermost sheet P1 is curved along the sheet feeding direction on its trailing edge side, so that the uppermost sheet P1 is hardly curved in the direction orthogonal to the direction in which the second and subsequent sheets P2 are fed as illustrated in FIG. 14, which is a diagram viewed from the direction indicated by an arrow B in FIG. 13B.

Thus, the uppermost sheet P1 is curved along the sheet feeding direction and the second and subsequent sheets P2 are curved along the step to produce the gap G between the uppermost sheet P1 and the top surface of the second and subsequent sheets P2.

The front end of the pressing portion 24*a* abuts on the top surface of the sheet P2, so that the gap G is also substantially produced between the uppermost sheet P1 and the front end of the pressing portion 24*a*. In other words, the uppermost sheet P1 is separated from the pressing portion 24*a* of the separation claw 24.

Figure 15:
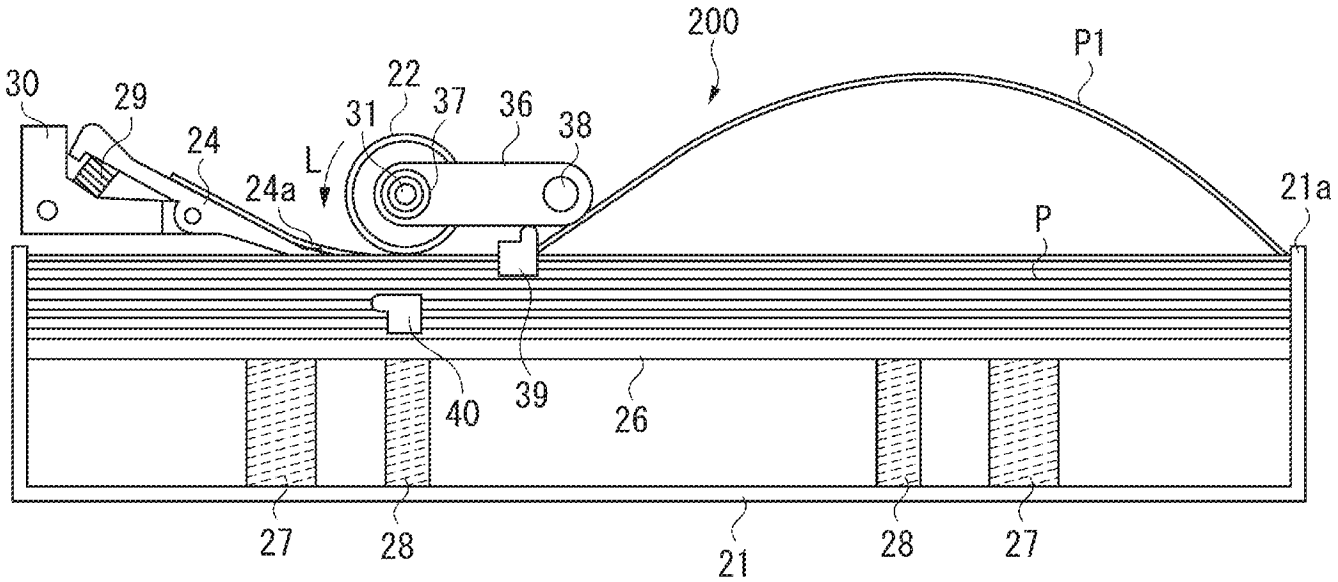
FIG. 15 is a diagram illustrating the sheet feeding operation of the sheet feeding apparatus.
Figures 16A, 16B, 16C:
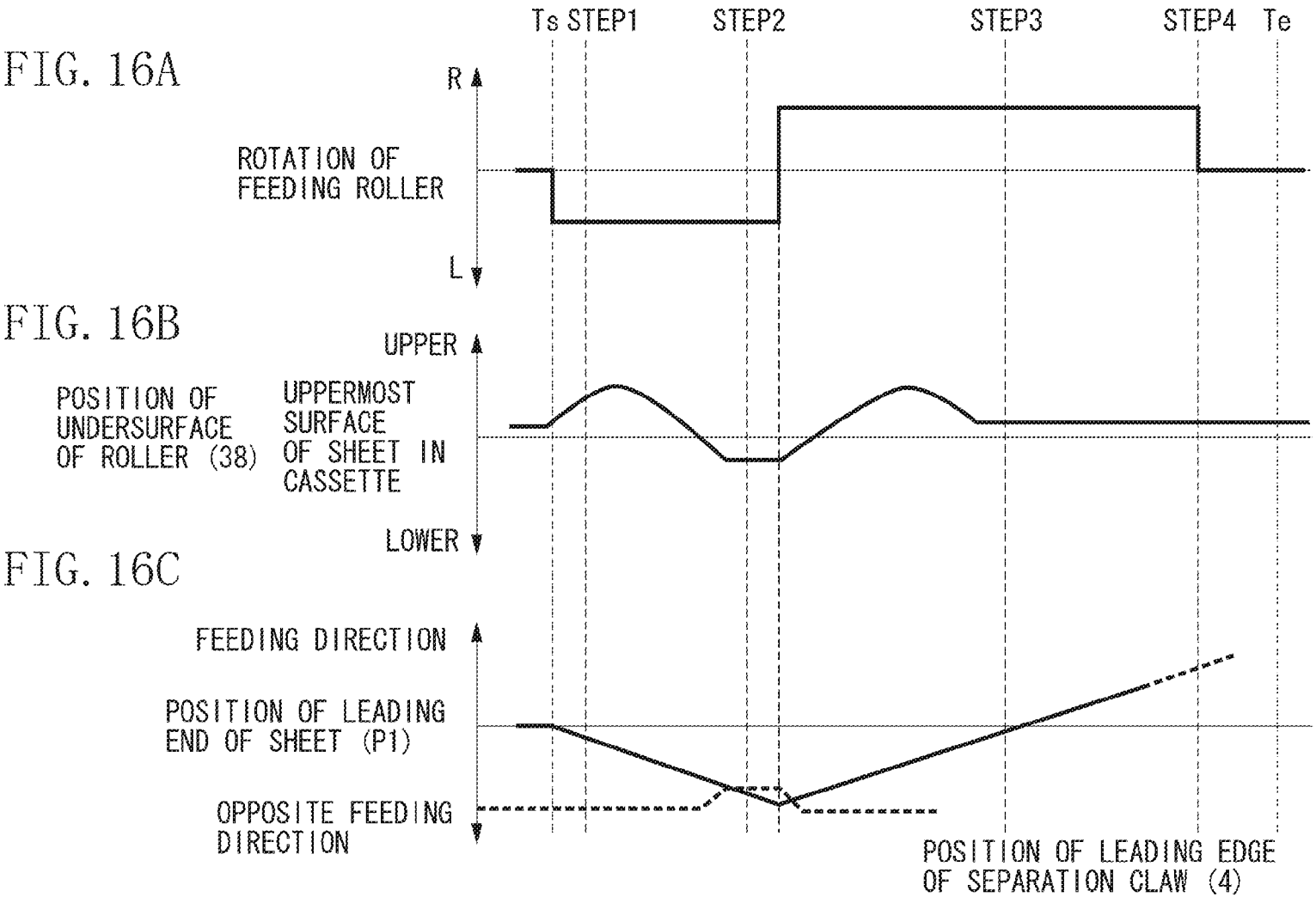
FIGS. 16A-16C are timing charts illustrating the sheet feeding operation of the sheet feeding apparatus.

As illustrated in FIG. 15, in step S13, the feeding roller 22 is forwardly rotated in the sheet feeding direction (in the direction indicated by the arrow R) by a predetermined amount to feed the upper sheet P1. The pressing portion 24*a* of the separation claw 24 is lower in position than the uppermost sheet P1 and separated therefrom. Therefore, the uppermost sheet P1 climbs up the separation claw 24 to be sent out without abutting on the front end of the pressing portion 24*a* of the separation claw 24.

In step S13, the depression arm 36 is rotated in the direction in which the feeding roller 22 is rotated, i.e., in the direction in which a curvature amount is decreased to abut on the upper stopper 39. Thereafter, even if the feeding roller 22 continues rotating, only the depression arm 36 is stopped by the effect of the bidirectional torque limiter 37.

The length of the depression arm 36 and the diameter of the feeding roller 22 are controlled so that the uppermost sheet P1 climbs up the separation claw 24 at a stage where the curvature amount of the sheet is zero or before the sheet feeding operation retunes to the initial state illustrated in FIG. 12A.

In other words, the length of the depression arm 36 and the diameter of the feeding roller 22 are controlled so that the uppermost sheet P1 climbs up the separation claw 24 at a stage where the curvature amount of the sheet is zero or the gap G lies between the uppermost sheet P1 and the second and subsequent sheets P2.

After that, in step S14, the separated uppermost sheet P1 is sent out, and when the uppermost sheet P1 passes by the feeding roller 22, the drive of the feeding roller 22 is stopped. Thus, only the uppermost sheet P1 among the sheets P stacked in the sheet feeding cassette 21 is fed. In this step, the sheet feeding apparatus 200 returns to the initial state illustrated in FIG. 12A, and thereafter, by repeating steps 11 to 14, the second and subsequent curved sheets P2 are fed.

As described above, in the present exemplary embodiment, when the sheet is fed along the upper surface of the separation claw 24, both ends of the sheet are curved by the depression arms 36 and the pressing portion 24*a* of the separation claw 24 is moved to a position lower than the uppermost sheet P1. This allows the sheet to be stably separated and fed, and the sheet feeding apparatus to be downsized, and also allows the sheet to be stably fed without being broken and failing to be fed.

In the second exemplary embodiment, although the torque limiter is used to operate the feeding roller 22 along with the depression arm 36, the present invention is not limited thereto. The diameter of the feeding roller is adjusted to optimize the conveyance amount of the feeding roller and the movement angle of the depression arm, for example, allows eliminating the need for the torque limiter.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-283366 filed Dec. 26, 2011, which is hereby incorporated by reference herein in its entirety.

What is claimed is:

1. A sheet feeding apparatus comprising:

a sheet support portion configured to support a plurality of sheets;

a forwardly or reversely rotatable feeding roller configured to send an uppermost sheet from among the sheets supported by the sheet support portion;

a separation claw having pressing portions configured to press both ends of a sheet supported by the sheet support portion in the width direction thereof and orthogonal to a direction in which the sheet is fed, and configured to separate the uppermost sheet in response to a forward or reverse rotating of the feeding roller;

a curvature formation portion configured to form a curvature so both ends, in a width direction of the sheet supported by the sheet support portion, become lower than a center portion thereof; and a control unit configured to control the feeding roller and the curvature formation portion to rotate the feeding roller in a direction opposite to the direction in which the sheet is fed, to remove the uppermost sheet from the separation claw, move the separation claw so that the pressing portions lie at a position separated from and lower than the uppermost sheet, and rotate the feeding roller in the direction in which the sheet is fed.

2. The sheet feeding apparatus according to claim 1, wherein the sheet support portion includes a center supporting portion which supports a center portion in the width direction of the sheet and a both-end supporting portion which supports both ends in the width direction of the sheet, is separated from the center supporting portion, and relatively elevated, and wherein the curvature formation portion lowers the both-end supporting portion to cause a step between the center supporting portion and the both-end supporting portion to form curvature, and the pressing portions of the separation claw integrally move lower while abutting on the both ends of the sheet to be separated from the uppermost sheet.

3. The sheet feeding apparatus according to claim 2, wherein the curvature formation portion includes rotatable depression levers which are rotated to depress the both-end supporting portion.

4. The sheet feeding apparatus according to claim 1, wherein the sheet support portion includes a center supporting portion which supports a center portion in the width direction of the sheet and a both-end supporting portion which supports both ends in the width direction of the sheet, is separated from the center supporting portion, and can be relatively elevated, and wherein the curvature formation portion depresses both ends in the width direction of the sheet which are supported by the sheet support portion to lower the both-end supporting portion, causing a step between the center supporting portion and the both-end supporting portion to form curvature, and the pressing portions of the separation claw integrally lower while abutting on both ends of the sheet to be separated from the uppermost sheet.

5. The sheet feeding apparatus according to claim 4, wherein the curvature formation portion includes depression arms rotated along with the rotation of the feeding roller, and the depression arms are rotated by the rotation of the feeding roller in the direction in which the sheet is fed to press both ends in the widthwise direction of the sheet.

6. The sheet feeding apparatus according to claim 5, wherein the depression arms are attached to a drive shaft of the feeding roller via a torque limiter.

7. The sheet feeding apparatus according to claim 1, wherein the control unit controls the curvature formation portion to curve the sheets supported by the sheet support portion before the feeding roller starts rotating in the direction in which the sheet is fed after rotated in the direction opposite to the direction in which the sheet is fed.

8. An image forming apparatus comprising:

a sheet support portion configured to support a plurality of sheets;

a forwardly or reversely rotatable feeding roller configured to send an uppermost sheet from among the sheets supported by the sheet support portion;

a separation claw having pressing portions configured to press both ends of the sheet supported by the sheet support portion in the width direction thereof and orthogonal to a direction in which the sheet is fed, and configured to separate the uppermost sheet in response to a forward or reverse rotating of the feeding roller;

a curvature formation portion configured to form a curvature so both ends, in the width direction of the sheet supported by the sheet support portion, become lower than a center portion thereof;

a control unit configured to control the feeding roller and the curvature formation portion to rotate the feeding roller in a direction opposite to the direction in which the sheet is fed to remove the uppermost sheet from the separation claw, move the separation claw so that the pressing portions lie at a position separated from and lower than the uppermost sheet, and rotate the feeding roller in the direction in which the sheet is fed; and an image forming unit configured to form an image on the sheet fed by the feeding roller.

9. The image forming apparatus according to claim 8, wherein the sheet support portion includes a center supporting portion which supports a center portion in the width direction of the sheet and a both-end supporting portion which supports both ends in the width direction of the sheet, is separated from the center supporting portion, and relatively elevated, and wherein the curvature formation portion lowers the both-end supporting portion to cause a step between the center supporting portion and the both-end supporting portion to form curvature, and the pressing portions of the separation claw integrally move lower while abutting on the both ends of the sheet to be separated from the uppermost sheet.

10. The image forming apparatus according to claim 9, wherein the curvature formation portion includes rotatable depression levers which are rotated to depress the both-end supporting portion.

11. The image forming apparatus according to claim 8, wherein the sheet support portion includes a center supporting portion which supports a center portion in the width direction of the sheet and a both-end supporting portion which supports both ends in the width direction of the sheet, is separated from the center supporting portion, and can be relatively elevated, and wherein the curvature formation portion depresses both ends in the width direction of the sheet which are supported by the sheet support portion to lower the both-end supporting portion, causing a step between the center supporting portion and the both-end supporting portion to form curvature, and the pressing portions of the separation claw integrally lower while abutting on both ends of the sheet to be separated from the uppermost sheet.

12. The image forming apparatus according to claim 11, wherein the curvature formation portion includes depression arms rotated along with the rotation of the feeding roller, and the depression arms are rotated by the rotation of the feeding roller in the direction in which the sheet is fed to press both ends in the widthwise direction of the sheet.

13. The image forming apparatus according to claim 12, wherein the depression arms are attached to a drive shaft of the feeding roller via a torque limiter.

14. The image forming apparatus according to claim 8, wherein the control unit controls the curvature formation portion to curve the sheets supported by the sheet support portion before the feeding roller starts rotating in the direction in which the sheet is fed after rotated in the direction opposite to the direction in which the sheet is fed.

15. A sheet feeding method comprising:

reversely feeding an uppermost sheet from among a plurality of sheets supported by a sheet support portion by a feeding roller rotating in a direction opposite to a direction in which the sheet is fed;

drawing out the leading end of the uppermost sheet from pressing portions provided on a separation claw and configured to press both ends of the sheet supported by a sheet support portion in the width direction thereof orthogonal to the direction in which the sheet is fed, and curving the sheet in the direction in which the sheet is fed;

forming curvature by a curvature formation portion so that both ends in the width direction of the sheet supported by the sheet support portion become lower than a center portion;

moving the pressing portions to a position separated from the uppermost sheet along with the curvature of the sheet; and sending out the uppermost sheet along the upper surface of the separation claw by rotating the feeding roller in the direction in which the sheet is fed.

16. The sheet feeding method according to claim 15, wherein the feeding roller is rotated in the direction in which the sheet is fed to send the uppermost sheet after curvature is formed by the curvature formation portion so both ends in the widthwise direction of the sheet supported by the sheet support portion become lower than a center portion.

* * * * *